United States Patent [19]

Huggins

[11] Patent Number: 4,777,730

[45] Date of Patent: Oct. 18, 1988

[54] OPEN SIGHT ADDITION FOR A TELESCOPIC GUN SIGHT

[76] Inventor: Edward R. Huggins, P.O. Box 78, Klawock, Ak. 99925

[21] Appl. No.: 892,836

[22] Filed: Aug. 4, 1986

[51] Int. Cl.[4] ..... F41G 1/38

[52] U.S. Cl. ..... 33/245; 42/101

[58] Field of Search ..... 33/245, 247, 252, 254, 33/255, 259, 260, 261; 42/100, 101

[56] References Cited

U.S. PATENT DOCUMENTS

| | | | |
|---|---|---|---|
| D. 253,545 | 11/1979 | Chesnut | D22/8 |
| 374,202 | 12/1887 | Rice | 33/247 |
| 600,104 | 3/1898 | Weed | 33/255 |
| 1,210,191 | 12/1916 | Moore | 33/255 |
| 1,288,379 | 12/1918 | Burton | 33/255 |
| 1,602,116 | 10/1926 | Manahan et al. | 33/247 |
| 2,054,090 | 9/1936 | Marple | 33/46 |
| 2,556,903 | 6/1951 | Clark | 33/245 |
| 3,149,622 | 9/1964 | Mann | 33/252 |
| 3,463,430 | 8/1969 | Rubin et al. | 248/205 |
| 3,626,597 | 12/1971 | Darrah | 33/252 |
| 3,785,603 | 1/1974 | Apel | 33/247 |
| 3,831,285 | 8/1974 | Vissing | 33/244 |
| 3,961,423 | 6/1976 | Hrebar | 33/258 |
| 4,021,926 | 5/1977 | Hrebar | 33/258 |
| 4,429,468 | 2/1984 | Jimenez et al. | 33/245 |
| 4,461,087 | 7/1984 | Norman | 33/249 |

FOREIGN PATENT DOCUMENTS

| | | | |
|---|---|---|---|
| 42231 | of 1888 | Fed. Rep. of Germany | 33/255 |
| 1572356 | 7/1980 | United Kingdom | 33/245 |

*Primary Examiner*—William A. Cuchlinski, Jr.
*Assistant Examiner*—Patrick R. Scanlon
*Attorney, Agent, or Firm*—Delbert J. Barnard

[57] ABSTRACT

A two-part mounting ring (58) mounts a rear sight element (100, 114) of an open gun sight on a rear portion of a telescopic gun sight (10). A forward two-part mounting ring (32) mounts a forward open sight element (28) on a forward portion of the telescopic gun sight (10). The upper portion of the rear mounting ring (58) includes a vertical slideway (74). The rear sight element (100, 114) has a slide body (76, 106) located within the slideway (74) which is adjustable up and down along the slideway (74). A sight line carrying element (98, 112) is secured to the slide body (76, 106). The sight line carrying element (90) may be pivotally attached (94) to the slide body (76), for pivotal movement about a horizontal axis (94), between an upright in use position and an inactive position down close against the telescopic gun sight (FIG. 2). The front mounting ring (32) has an upper major portion (34) and a lower minor portion (36). The ring portions (34, 36) are secured together by fastener means (46, 48) which extend between fastener ears (38, 42 and 40, 44) at the ends of the two ring portions (34, 36). The fastener ears (38, 42 and 40, 44) are located within a horizontal zone (FIG. 4) which is substantially tangent to the lower boundary of a telescopic sight (10) and is narrower than the diameter of the telescopic sight (10).

3 Claims, 3 Drawing Sheets

Fig. 3
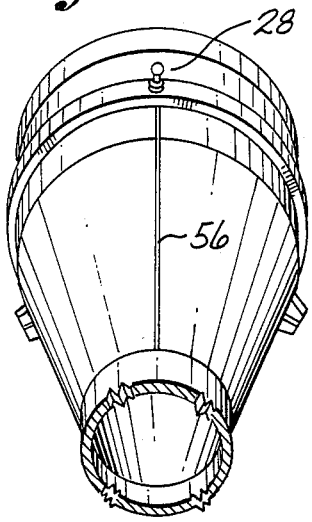
Fig. 4
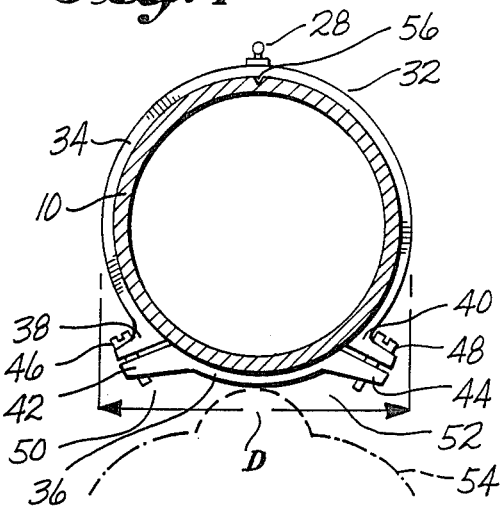
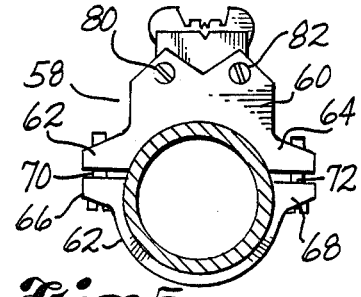
Fig. 5
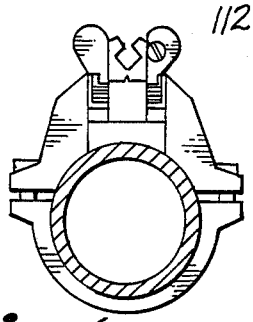
Fig. 6
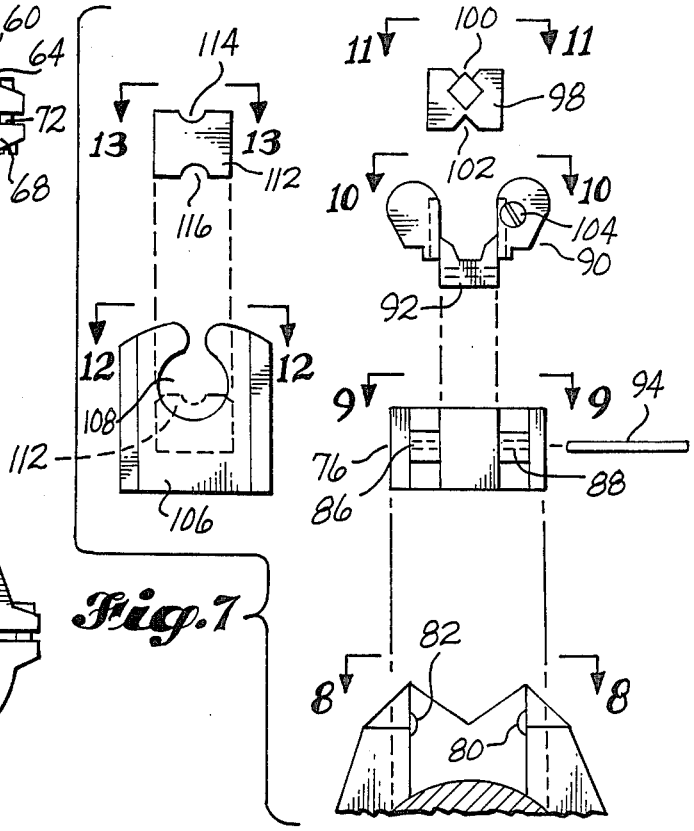
Fig. 7

OPEN SIGHT ADDITION FOR A TELESCOPIC GUN SIGHT

DESCRIPTION

1. Technical Field

This invention relates to gun sights. more particularly, it relates to the provision of an open sight on the upper portion of a telescopic gun sight.

2. Background Art

A telescopic gun sight is a telescope which includes cross hairs and which is mounted onto the gun, usually to serve as the sole means for aiming the gun towards a target. A problem with a telescopic sight is that it is difficult to use it to pick up a close fast moving target such as a running dear. Also, atmospheric conditions may cause the sight to fog up and be unusable. Further, variable power telescopic sights must be turned down in power for close shots and this takes time. For this and other reasons, a telescopic sight would be essentially worthless if the gun had to be used quickly, to shoot a target at close distance. For example, a hunter having a rifle equipped with only a telescopic sight would be in trouble if he was threatened by a bear at short distance.

U.S. Pat. No. 3,463,430, granted Aug. 26, 1969, to Irving N. Ruben and Ivan Jimenez and U.S. Pat. No. 4,429,468, granted Feb. 7, 1984, to Ivan Jimenez and Irving N. Ruben, each discloses a mount for a telescopic sight which includes an open sight avenue below the telescope. A rear sight element is mounted on the gun, immediately forwardly of the telescopic sight. A front sight element is provided at the front end of the gun. These two sight elements define a sight line which is below the telescopic sight. A problem with this type of arrangement is that it is necessary to elevate the telescopic sight, thus moving the sight line of the telescopic sight away from the axis of the gun barrel. Also, the sight line is restricted both horizontally and vertically, making it more difficult to sight in on a target. This is because the user must sight through openings. The mounts defining the openings block the field of view both above and to the sides of the sight plane. Further, with the increased height of the telescopic sight above the gun it is easier for the telescopic sight to make contact with brush, etc. when being carried through the woods. Also, it would prevent the use of a scabard.

U.S. Pat. No. 3,961,423, granted June 8, 1976, to Matthew J. Hrebar, and U.S. Pat. No. 4,021,926, granted May 10, 1977, also to Matthew J. Hrebar, each discloses mounting an auxilary sight on the gun, mounted to one side of the telescopic sight. This requires a second attachment to the gun body and locates the sight at an unnatural position, viz. to one side of the barrel.

U.S. Pat. No. 4,461,087, granted July 24, 1984 to Ray Norman, discloses a telescopic sight mount which allows the telescopic sight to be swung over sideways, out of its normal position on top of the gun. This allows the user to use conventional open sights on the gun, but it requires an unlocking and moving of the telescopic sight.

Design Pat. No. 253,545, granted Nov. 27, 1979, to M. Gaines Chestnut discloses a clip-on attachment for a telescopic sight. This attachment comprises an elongated support having an open sight element at each of its ends, and a pair of spaced apart spring clips. The spring clips are snapped over the telescopic sight, to in this manner position the attachment on the telescopic sight. A problem with this type of device is that it is not controllable; the attachment is easily moved in position on the telescopic sight. Also, it appears that the device could be easily knocked off.

U.S. Pat. No. 2,054,090, granted Sept. 15, 1936, to Matthiasm Marple discloses an open sight attachment for a telescopic sight for an aircraft gun which comprises a pair of ring members which are attachable to front and rear portions of the tlescopic sight. Each ring member carries a plurality of sight elements. The attachments disclosed by this patent have extremely long sight elements. If such a system were to be used on a rifle or pistol, it would be very easy for the sight elements to strike something, resulting in their either being moved out of alignment, and/or being physically damaged.

A principal object of the present invention is to provide an open sight addition for a telescope sight which provides a quick-to-use open sight plane on top of the telescopic sight, and comprises sight elements which are positioned closely adjacent the telescopic sight envelope.

DISCLOSURE OF THE INVENTION

In accordance with an aspect of the invention, an open sight addition for a telescopic gun sight is provided in the form of a ring attachable to a front bell portion of the telescopic gun sight. The mounting ring is a two-part ring comprising an upper major portion and a lower minor portion. The major portion extends about the bell of the telescopic gun sight for a distance greater than 180°. The minor portion extends about the bell of the telescopic gun sight for a distance less than 180°. The major portion and the minor portion both have fastener ears. The fastener ears on the major portion are positionable adjacent the fastener ears on the minor portion when the major and minor portions of the ring are positioned on the bell of the telescopic gun sight. A sight element is located on the upper major portion of the ring. Fastener means extend between the fastener ears on the major portion of the ring and the fastener ears on the minor portion of the ring, to secure the two ring portions together and clamp them into a secure position on the bell of the telescopic gun sight. When the mounting ring is on the bell of the telescopic gun sight, the mounting ears are located within a horizontal zone which is substantially tangent to the lower boundary of the bell portion of the telescopic sight, and is narrower than the diameter of the bell of the telescopic sight.

The mounting ring is relatively thin. The only projecting parts are the sight element and the fastener ears. The construction of the mounting ring into two parts, and the location of the fastener ears below the telescopic sight, in nook areas formed by and between the telescopic sight and the gun, minimize the chance of the fastener ears catching on brush, etc. as the gun is carried through the woods. Preferably, the sight element is a short sight bear which projects only a small distance upwardly above the upper boundary of the telescopic sight.

In accordance with another aspect of the invention, the bell portion of the telescopic gun sight is provided with an axial sight groove which extends a substantial distance and with the sight element on the mounting ring forms a sight plane. Sight grooves have been used in other environments.

In accordance with a further aspect of the invention, a rear sight element is provided which is itself mounted by a ring on the telescopic gun sight. The ring includes an upper mounting portion and a rear sight element on the upper mounting portion. The upper mounting portion includes a vertical slideway. The rear sight element is located within the slideway and is adjustable in position up and down along said slideway. The rear sight element and slideway include lock means for locking the rear sight element in position relative to the slideway. The rear sight element includes a sight line means usable with the sight element at the front of the telescopic sight, for defining an open sight plane on top of the telescopic gun sight.

In one form, the rear sight element comprises a slide body movable within the slideway. A sight line element is pivotally attached to the slide body, for pivotal movement about a horizontal axis, between an upright use position and an inactive position. When the sight line element is in its inactive position it is generally against the telescopic sight. The sight line element includes the sight line means.

Other features of the invention are hereinafter described in the Best Modes for Carrying out the Invention.

BRIEF DESCRIPTION OF THE DRAWINGS

Like reference numerals are used to designate like parts throughout the several views of the drawings, and:

FIG. 3 is a view taken generally from the aspect of line 3—3 in FIG. 2, showing a front sight bead on the front ring and a sight blade engraved in the bell portion of the telescopic sight, extending rearwardly from the sight bead;

FIG. 4 is a sectional view taken substantially along line 4—4 of FIG. 2;

FIG. 5 is a sectional view taken substantially along line 5—5 of FIG. 2;

FIG. 6 is a sectional view taken substantially along line 6—6 of FIG. 2;

FIG. 7 is an exploded end elevational view, taken substantially from the same aspect as FIG. 6, and showing two types of rear sight inserts, in spaced relationship to a rear sight mount;

BEST MODES FOR CARRYING OUT THE INVENTION

Figure 1:
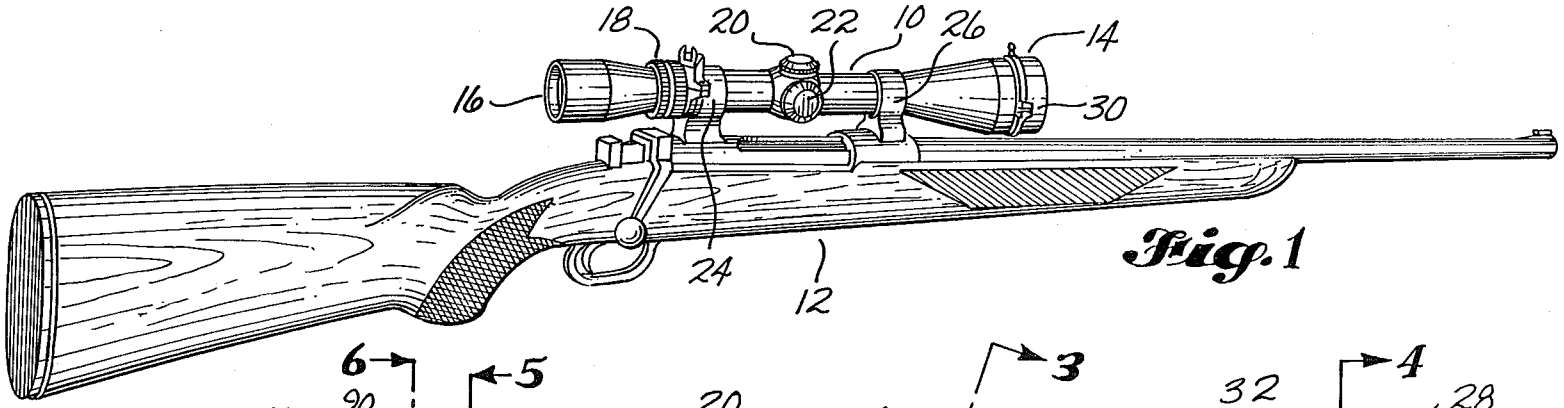
FIG. 1 is a pictorial view of a telescopic sight, mounted on a rifle, and including an embodiment of the invention.

FIG. 1 shows a telescopic sight 10 mounted on top of a rifle 12. The particular telescopic sight 10 that is illustrated includes an enlarged foward end or "bell" 14. An eyepiece 16 is provided at the rear end of the telescopic sight 10. A focusing ring 18 is provided forwardly of the eyepiece 16. The sight 10 includes adjustable cross hairs which provide an internal sight line. Mechanism is provided for adjusting the cross hairs. This mechanism is accessible by removing a pair of caps 20, 22.

The telescopic sight 10 is mounted onto the rifle 12 by means of a pair of mounting rings 24, 26.

In this embodiment, an open sight element is provided at the forward end of the telescopic sight 10. Preferably, this forward sight element is a sight bear 28. It is centered on top of the telescopic sight 10 and is preferably positioned as far forward on the telescopic sight 10 as is possible. The particular telescopic sight 10 that is illustrated comprises a removable ring 30, which is part of the lens system. The forward sight element 28 is shown to be secured to an upper center portion of a forward mounting ring 32 positioned rearwardly adjacent ring 30.

As best shown by FIG. 4, mounting ring 32 comprises an upper major portion 34 and a lower minor portion 36. Major portion 34 extends about the telescopic sight 10 an angular distance greater than 180°. The minor ring portion 36 extends about the remainder of the telescopic sight 10. Thus, it extends a distance less than 180°. Major ring portion 34 includes two ends and fastener ears 38, 40 at its ends. Ring portion 36 also includes two ends and fastener ears 42, 44 at its two ends. When the two ring portions 34, 36 are assembled on the telescopic sight 10, the mounting ears 38, 40 are adjacent the mounting ears 42, 44, respectively. Fastener elements, which may be screw fasteners 46, 48, extend between the mounting ears 38, 42 and 40, 44, and serve to connect the two ring portions 34, 36 together. When tightened, the fastener elements 46, 48 also serve to clamp the mounting ring 32 in position on the large diameter forward end part of the bell portion of the telescopic sight 10. As will be readily understood, the position of the forward sight element 28 can be adjusted by rotating the forward mounting ring 32, while it is loose on the telescopic sight 10. Once adjusted, the fastener elements 46, 48 can be tightened, for the purpose of securely clamping the mounting ring 32 in place.

As shown by FIG. 4, the fastener ear pairs 38, 42 and 40, 44 are located within a horizontal zone that is substantially tangent to the lower boundary of the front end of the telescopic sight 10. This zone has a width which is less than the diameter D of the tubular end of the telescopic sight 10. This places the fastener ear pairs 38, 42 and 40, 44 within protected zones or recesses 50, 52 which are formed by and between the lower portions of the tubular front end of the telescopic sight 10 and the upper portion of the gun barrel and stock 54. As a result, the fastener ear pairs 38, 42 and 40, 44 do not project outwardly any appreciable distance from the effective side boundaries of the sight gun combination 10, 12.

The forward sight element 28 may be used in conjunction with an elongated axial sight line 56, for defining a sight plane. As shown by FIG. 3, this sight line 56 is formed on the upper side boundary portion of the bell of the telescopic sight 10. Sight line 56 may be an etched line, a painted line, a rib, etc. When this combination of sight elements 28, 56 are used, the mounting ring 32 is positioned on the bell of the telescopic sight 10. Before the screws 46, 48 are tightened, the ring 32 is rotated to align the element 28 with the groove 56. Then, the screws 46, 48 are tightened. The entire telescopic sight 10 is then rotated within its mounts, for the purpose of centering the sight line established by elements 28, 56 within a substantially vertical plane.

In accordance with an aspect of the invention, a longer sight plane can be established by using with the forward sight element 28 a rear sight element that is positioned on the telescopic sight 10 as far to the rear of the sight 10 as is possible. This may be done by providing a rear mounting ring 58 on the telescopic sight 10, between sight mount ring 24 and the power adjustment ring 18.

As shown by FIGS. 5 and 6, the rear mounting ring 58 may comprise upper and lower portions 60, 62. Upper portion 60 may include fastener ears 62, 64. Lower portion 62 may include fastener ears 66, 68. The ring members 60, 62 are positioned on the body of the telescopic sight 10 and screw fasteners 70, 72 are applied, for the purpose of securing the two parts 60, 62 together. As in the case of the forward mounting ring 32, the parts 60, 62 are first loosely connected together. Then, the ring 58 is rotated in position to place a rear sight line establishing element within a vertical plane. Then, the screw fasteners 70, 72 are tightened, for the purpose of tightly clamping the ring 58 to the tubular body of the telescopic sight 10.

Figure 8:
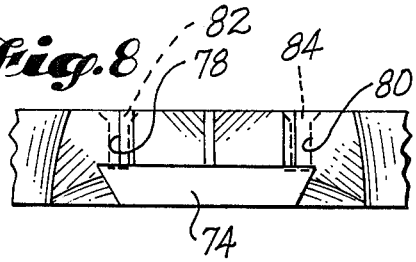
FIG. 8 is a plan view taken substantially from the aspect of line 8—8 in FIG. 7.
Figure 11:
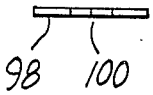
FIG. 11 is a top plan view taken substantially from the aspect of line 11—11 in FIG. 7.
Figure 9:
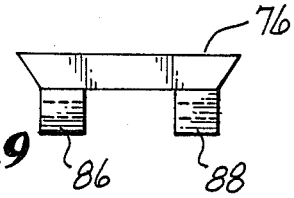
FIG. 9 is a plan view taken substantially from the aspect of line 9—9 in FIG. 7.

Preferably, the upper part 60 of ring 58 includes a vertical slideway 74 (FIG. 8). A slide body 76 is slidably received within the slideway 74. As shown by FIGS. 8 and 9, the cross section of the slideway 74 and the body 76 are of dovetail construction, such that the body 76 can slide within the slideway 74, but is otherwise prevented from leaving the slideway 74. A front wall of the upper ring portion 60 may be provided with two internally threaded openings 78, 80 in which clamp screws 82, 84 are received. The slide body 76 is positioned within the slideway 74 and is moved vertically, for the purpose of effecting a vertical adjustment of the rear sight element. When the rear sight element is in its proper position, the clamp screws 82, 84 are tightened for the purpose of securing the body 76 in position relative to the mounting ring portion 60.

Slide body 76 carries a pair of hinge ears 86, 88. A sight line carrying element 90 is provided which includes a single hinge ear 92. Hinge ear 92 is positioned between hinge ears 86, 88, and a hinge pin 84 is inserted through aligned openings in the three ears 86, 88, 92, to complete a knuckle hinge connection between member 90 and slide body 76. This hinge connection serves to mount member 90 for movement between an upright in use position, as shown by a solid line in FIG. 2, and also shown in FIGS. 1, 5 and 6, and an inactive position in which it is down relatively against the telescopic sight 10. This inactive position is shown in broken line in FIG. 2.

Figure 10:
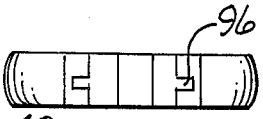
FIG. 10 is a plan view taken substantially from the aspect of line 10—10 in FIG. 7.

Element 90 may be what is commonly referred to as a "buckhorn". It includes a vertical slot 96 (FIG. 10) in which a sight element 98 is received. Sight element 98 is constructed from a flat piece of material and has elements 100, 102 which can be aligned with the front sight element 28, to form a sight plane. Member 90 includes a clamp screw 104 which when tightened exerts a clamping pressure between member 90 and member 98, securing the two members together.

Figure 12:
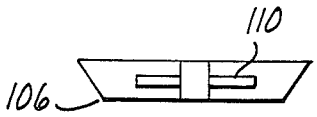
FIG. 12 is a top plan view taken substantially from the aspect of line 12—12 of FIG. 7.
Figure 13:
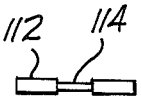
FIG. 13 is a top plan view taken substantially from the aspect of line 13—13 of FIG. 7.

A second type of insert for the slideway is shown in FIGS. 7, 12 and 13. It is what is referred to as a full buckhorn. It comprises a slide body 106 which fits down into the slideway 74, the same as slide body 76. Slide body 106 includes a circular opening 108 and a vertical slideway 110 (FIG. 12) into which an insert 112 is received. Insert 112 includes sight notches 114, 116. Insert 112 is inserted down into slot 110. When it is in place, it locates the notch 114, 116 which is directed upwardly within the opening 108. This notch is aligned with the forward sight element 28 to define the sight plane.

Figure 2:
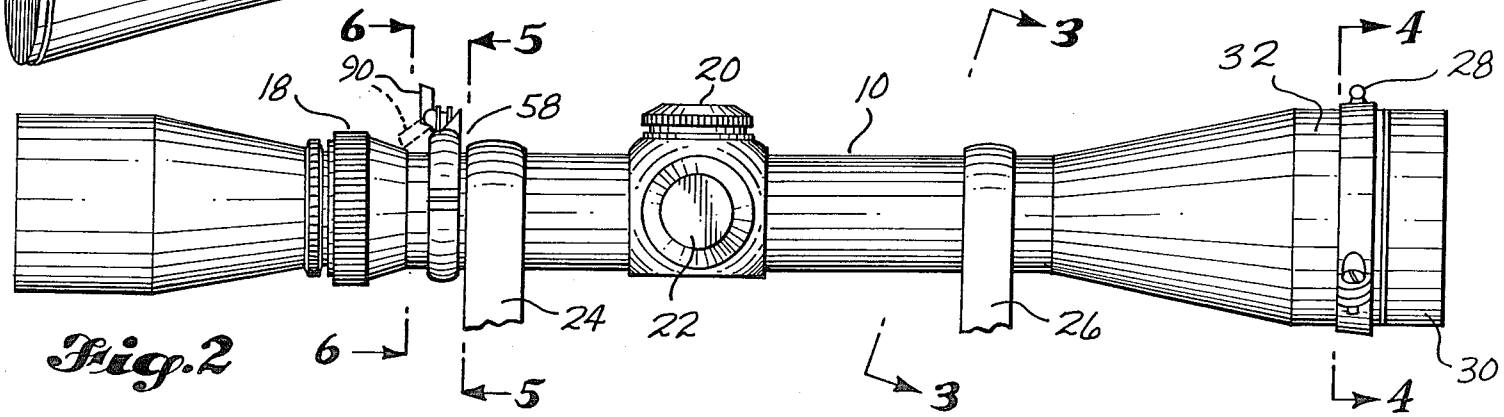
FIG. 2 is an enlarged scale side elevational view of the telescopic sight shown in FIG. 1, showing front and rear ring mounted open sight components, constructed in accordance with the present invention.

As shown by FIGS. 1 and 2, the mounting ring 58 is relatively thin and is located within a protected nook area between the scope mount ring 24 and the power adjustment ring 18. Regardless of what type of rear sight element is used, the rear sight element projects upwardly above the telescopic sight 10 only a distance sufficient to position the sight line above cap 20 (and the bell when present). Of course, when a folding buckhorn type sight is used, and the buckhorn element 90 is folded down (FIG. 2) only a small part of the rear sight element projects upwardly above the general envelope of the telescopic sight 10.

Figure 14:
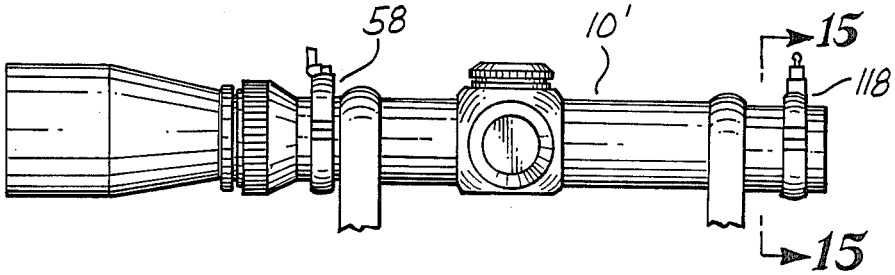
FIG. 14 is a side elevational view of a second type of telescopic sight, including a modified form of front attachment.
Figure 15:
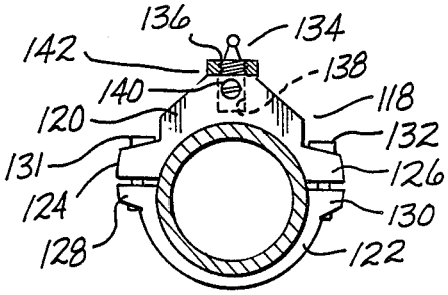
FIG. 15 is a sectional view taken substantially along line 15—15 of FIG. 14.

The sight element mounting ring 58 may be used with a telescopic sight 10' which does not include a bell at its forward end. This type of sight is shown by FIG. 14. A sight of this configuration may be used on a rifle, a shotgun or a combination gun (rifle and shotgun). Also, there are sights of this configuration for use on a pistol. As shown by FIGS. 14 and 15, when a telescopic sight 10' is used which does not include a bell at its forward end, a mounting ring 118 can be used which is very similar in construction to mounting ring 58. It comprises an upper, sight element mounting portion 120, and a lower portion 122. Fastener ears 124, 126 are provided at the ends of ring portion 120. Fastener ears 128, 130 are provided at the ends of ring portion 122. Screw fasteners 131, 132 extend between the mounting ear pairs 124, 128 and 126, 130, respectively, to secure the two ring members 120, 122 together. As before, the ring 118 is rotated in position for placing the sight element 134 within a vertical plane. Then, the screws 131, 132 are tightened, for the purpose of clamping the ring 118 to the tubular body of the telescopic sight 10'.

In this embodiment, the forward sight element 134 is shown in the form of a sight bead having a threaded base 136. Base 136 threads into an internally threaded socket 138 formed in an upper portion of ring member 120. A lock screw 140 may be provided for holding the element 134 in place. A lock nut 142 may be used in place of in addition to the lock screw 140.

By way of typical and therefore nonlimitative example, the dimensions of a front ring 32, for use with a telescopic sight having a bell with an outside diameter of 1 29/32 inches, are as follows: the bear is 3/32 inch wide at the top and is 1/16 inch long. The ring portions 34, 36 are 1/16 inch thick and 5/16 inch wide. The major ring portion 34 extends 270° and the minor ring portion 36 extends 90°.

Each of the sight systems of this invention gives the shooter a full view above the gun, resulting in the sight system being usable quickly to aim the gun at a target. The open sight addition does not detract from the normal use of the telescopic sight in any way. The open sight is readily available for use in those situations in which an open sight is superior to a scope sight, e.g. close range use or for aiming at a fast moving target. Each of the add-on sight components is very strong and durable. At the same time they are small and can be made out of lightweight material. The simplicity of the add-on sight elements result in the system being relatively inexpensive. A system utilizing mounting rings can be very quickly and easily installed. The front sight element projects upwardly above the general envelope of the telescopic sight a very small amount. The rear sight element projects upwardly only an amount sufficient to position the sight line above the top cover for the mechanism for adjusting the cross hairs. When a fold-down buckhorn is used, the buckhorn is folded down generally into the envelope of the telescopic sight when it is not being used. In an installation in which the rear sight element is mounted on a mounting ring that is separate from the rear mounting ring for the telescopic sight, such mounting ring for the rear sight element is located in an annular region defined axially between the rear mounting ring for the telescopic sight and the focusing ring for the telescopic sight.

It is to be appreciated that the sighting system described above could be altered somewhat without departing from the spirit and scope of the invention. In accordance with established patent law, the system that has been illustrated and described is not to be used for defining the invention to be protected. Rather, the limits of protection are specified by the appended claims. These claims are to be interpreted in accordance with established rules of patent claim interpretation, including the use of the doctrine of equivalents.

What is claimed is:

1. An open sight addition for a telescopic gun sight of a type having front and rear mounts mounting it onto a gun, said open sight addition comprising:

a sight bead at an upper forward position of a telescopic gun sight;

a ring extending around a rearward portion of the telescopic gun sight, rearwardly of said rear mount, said ring comprising an upper member having fastener ears at its sides, a lower member having fastener ears at its sides, wherein when the ring is installed onto the rearward portion of the telescopic gun sight, the fastener ears of the lower member are adjacent the fastener ears of the upper member, and fastener elements extending between and connecting together the fastener ears of the upper member and the fastener ears of the lower member, for connecting the two members together and clamping them onto the rearward portion of the telescopic gun sight, said upper member having a vertical slideway which is open in the rearward direction and which has grooves on each side, and a rear sight element having edge portions received within said grooves, said rear sight element including a slide body located within said slideway, said slide body being adjustable in position up and down within said slideway, said upper member including means for locking the slide body in position relative to the slideway, and said rear sight element including a sight line element which is usable with the bead at the front end of the telescopic sight, for defining an open sight plane on top of the telescopic sight and said sight line element being pivotally attached to the slide body, for pivotal movement about a horizontal axis, between an upright use position and an inactive position generally against the telescopic sight, and said horizontal axis being spaced below the top of the slideway, resulting in said sight line element projecting rearwardly from the rear opening of the slideway, when the sight line element is folded down into its inactive position generally adjacent the telescopic sight.

2. An open sight addition according to claim 1, wherein said sight bead includes a mounting ring which surrounds the forward portion of the telescopic gun sight, and said sight bead is connected to the mounting ring, and said mounting ring includes means for securing said ring to the forward portion of the telescopic gun sight.

3. An open sight addition according to claim 2, wherein the telescopic gun sight is of a type having a front bell which includes a cylindrical forward portion and a frustoconical rearward portion, and said sight bead mounting ring surrounds the cylindrical forward portion of the bell.

* * * * *

UNITED STATES PATENT AND TRADEMARK OFFICE

CERTIFICATE OF CORRECTION

PATENT NO. : 4,777,730

DATED : Oct. 18, 1988

INVENTOR(S) : Edward R. Huggins

It is certified that error appears in the above-identified patent and that said Letters Patent is hereby corrected as shown below:

Column 1, line 16, "dear" should be -- deer --.

Column 1, line 24, "was" should be -- were --.

Column 1, line 46, "scabard" should be -- scabbard --.

Column 1, line 50, "auxilary" should be -- auxiliary --.

Column 1, line 63, "Chestnut" should be -- Chesnut --.

Column 2, line 9, "tlescopic" should be -- telescopic --.

Column 2, line 60, "bear" should be -- bead --.

Column 4, line 19, "bear" should be -- bead --.

Column 5, line 4, "are" should be -- is --.

Column 5, line 35, "slide" should be -- mounting --.

Column 5, line 53, "hinge pin 84" should be -- hinge pin 94 --.

Column 6, line 59, "bear" should be -- bead --.

Column 7, line 7, "result" should be -- results --.

Signed and Sealed this

Fourteenth Day of November, 1989

*Attest:*

JEFFREY M. SAMUELS

*Attesting Officer* *Acting Commissioner of Patents and Trademarks*